United States Patent [19]

Mortensen, Sr.

[11] Patent Number: 4,627,299

[45] Date of Patent: Dec. 9, 1986

[54] ENGINE STARTER GEARING

[75] Inventor: Harold R. Mortensen, Sr., Murfreesboro, N.C.

[73] Assignee: Facet Enterprises, Inc., Tulsa, Okla.

[21] Appl. No.: 684,663

[22] Filed: Dec. 20, 1984

[51] Int. Cl.[4] ..... F02N 15/06

[52] U.S. Cl. ..... 74/7 A; 74/7 R

[58] Field of Search ..... 74/6, 7 R, 7 A; 290/38 C

[56] References Cited

U.S. PATENT DOCUMENTS

| | | | |
|---|---|---|---|
| 2,538,300 | 1/1951 | Digby | 74/7 |
| 2,546,954 | 3/1951 | Tobias | 74/7 R |
| 2,643,548 | 6/1953 | Miller | 74/7 R |
| 2,782,643 | 2/1957 | Miller | 74/6 |
| 2,815,669 | 12/1957 | Mendenhall | 74/7 R |
| 2,880,619 | 4/1959 | Digby | 74/7 R |
| 2,885,894 | 5/1959 | Mendenhall | 74/7 X |
| 2,938,391 | 5/1960 | Buxton | 74/7 R |
| 3,263,509 | 8/1966 | Digby | 74/7 R |
| 3,319,755 | 5/1967 | Digby | 74/7 X |
| 4,346,615 | 8/1982 | Yoneda et al. | 74/7 A |
| 4,425,812 | 1/1984 | Williams | 74/7 R X |

*Primary Examiner*—Allan D. Herrmann

*Attorney, Agent, or Firm*—Remy J. VanOphem

[57] ABSTRACT

An engine starter for engagement with the starting gear of an engine to be started. The engine starter has a power shaft rotatably driving a secondary driving clutch member through mutually engageable straight splines. The secondary driving clutch member drives the secondary driven clutch member through mutually engageable inclined dentil teeth which, in turn, rotatably drive a sleeve through mutually engageable helical splines. The sleeve rotatably drives a primary driving clutch member through mutually engageable helical splines which, in turn, drive the pinion gear through mutually engageable primary dentil teeth. An open ended housing is provided to enclose the several clutch members, the housing being provided with removable abutment means for containing the several clutch members therein. A first biasing element is provided between the secondary driven clutch member and the primary driving clutch member, and second biasing means are provided between the secondary driven clutch member and the housing. Both the first and second biasing means bias the secondary driven clutch member into engagement with the secondary driving clutch member. When the engine starter gearing experiences a sudden load from an engine preignition or a backfire condition, the sudden load is absorbed by the deflection of the first and second biasing means, as the secondary driving and driven clutch members rotate relative to each other.

15 Claims, 2 Drawing Figures

ENGINE STARTER GEARING

BACKGROUND OF THE INVENTION

The present invention relates to engine starter gearing for an engine and more particularly to engine starter gearing of the positive shift type including a primary dentil clutch to provide driving and overrunning, a device for effecting the automatic separation of the clutch teeth after the engine becomes self-running, and a secondary or overload dentil clutch to absorb excess loads.

Various designs for engine starter gearing have been offered in the past in an effort to accommodate the various operating conditions experienced by engine starter gearing. However, the increasing tendency towards size and weight reduction in all accessories used in association with motor vehicles has resulted in design compromises affecting the performance of the engine starter gearing and its ability to handle unusual load conditions. In particular, many current engine starters experience failure during the extremely high loads which occur, for example, during an engine backfire or preignition condition. Under conditions of extreme load or frequent repetitions of moderate load, the armature shaft of the engine starter gearing may bend or break. Accordingly, what is needed is an overload device to absord or distribute the high load which may otherwise cause damage.

Various designs for engine starter gearing have been offered in the past to compensate for the extreme loads experienced during a backfire or a preignition condition. Examples of such designs may be found in U.S. Pat. No. 2,546,954, issued Mar. 27, 1951 to Tobias; U.S. Pat. No. 2,643,548, issued June 30, 1953 to Miller; U.S. Pat. No. 2,782,643, issued Feb. 27, 1957 to Miller; U.S. Pat. No. 2,815,669, issued Dec. 10, 1957 to Mendenhall; U.S. Pat. No. 2,880,619, issued Apr. 7, 1959 to Digby; U.S. Pat. No. 2,885,894, issued May 12, 1959 to Mendenhall; and U.S. Pat. No. 2,938,391, issued May 31, 1960 to Buxton.

While engine starter gearing made according to the teachings of many of these prior patents function well in terms of the absorption of certain shock loads experienced by the engine starter gearing, those prior art designs which function well for that purpose have a tremendous number of parts which results in a large and heavy engine starter assembly which is difficult to assemble.

Accordingly, what is needed is a simple, lightweight, and compact design for engine starter gearing having the capability of absorbing, without damage, such sudden torsional shock loads.

SUMMARY OF THE PRESENT INVENTION

The present invention provides a compact, lightweight, and easy to assemble engine starter gearing for an engine which includes a dentil clutch to provide driving and overrunning, a device for effectuating the automatic separation of the clutch teeth after the engine becomes self-running, and an overrunning clutch device for effecting the automatic separation of the overrunning clutch teeth in the event of a sudden shock load.

More particularly, the engine starter gearing of the present invention includes a power shaft and a sleeve slidably and nonrotatably secured to the power shaft, the sleeve having external helical splines formed thereon. A pinion gear is slidably journalled for axial movement relative to the power shaft and adapted for movement into and out of engagement with a starting gear of the engine to be started. A primary driven clutch member is secured to the pinion gear for movement therewith. A primary driving clutch member is slidably mounted on the external helical splines of the sleeve. Complementary mutually engageable primary teeth are provided on the primary driving and driven clutch members for transmitting torque therebetween in one direction of relative rotation. A secondary driving clutch member is disposed adjacent one end of the sleeve remote from the pinion gear. A secondary or driven clutch member is slidably mounted on the helical splines of the sleeve and is disposed adjacent the secondary driving clutch member. Complementary mutually engageable secondary teeth are disposed on the secondary driving and driven clutch members for transmitting torque therebetween in one direction of relative rotation. A biasing element is interposed the secondary driven clutch member and the primary driving clutch member. A cylindrical housing having two open ends is disposed about the sleeve such as to spatially encompass the primary driven clutch member, the primary driving clutch member and the secondary driven clutch member. A resilient member is disposed within the cylindrical housing and mechanically interposed between the secondary driven clutch member and the cylindrical housing. A first abutment member is disposed within the cylindrical housing adjacent one open end thereof and is adapted for engagement with the primary driven clutch member. A second abutment member is disposed within the cylindrical housing adjacent an other open end thereof remote from the one open end thereof and is adapted for engagement with a portion of the secondary driving clutch member. The second abutment member cooperates with the first abutment member to rotatably confine the primary driven clutch member, the primary driving clutch member, the secondary driven clutch member, and a portion of the secondary driving clutch member within the cylindrical housing.

In the preferred embodiment, the resilient member is an annular member disposed about the biasing member. Furthermore, in the preferred embodiment, automatic separation of the complementary mutually engageable primary clutch teeth after the engine becomes self-running is provided by an appropriate device, such as a centrifugal flyweight subassembly. Additionally, the secondary driving clutch member is formed integrally with a shift collar for the engine starter gearing in the preferred embodiment.

The primary object of the present invention is to provide an efficient, compact, and lightweight engine starter gearing having the capability to absorb, without damage, sudden torsional shock loads.

It is a further object of the present invention to provide such an engine starter gearing having few components and being easy to assemble.

These and many other objects, features and advantages of the present invention will become apparent to those skilled in the art upon reading the following detailed description of the preferred embodiment in conjunction with the drawings appended hereto.

BRIEF DESCRIPTION OF THE DRAWING

In the drawing, wherein like reference numerals refer to like components throughout.

DETAILED DESCRIPTION OF THE PREFERRED EMBODIMENT

Figure 1:
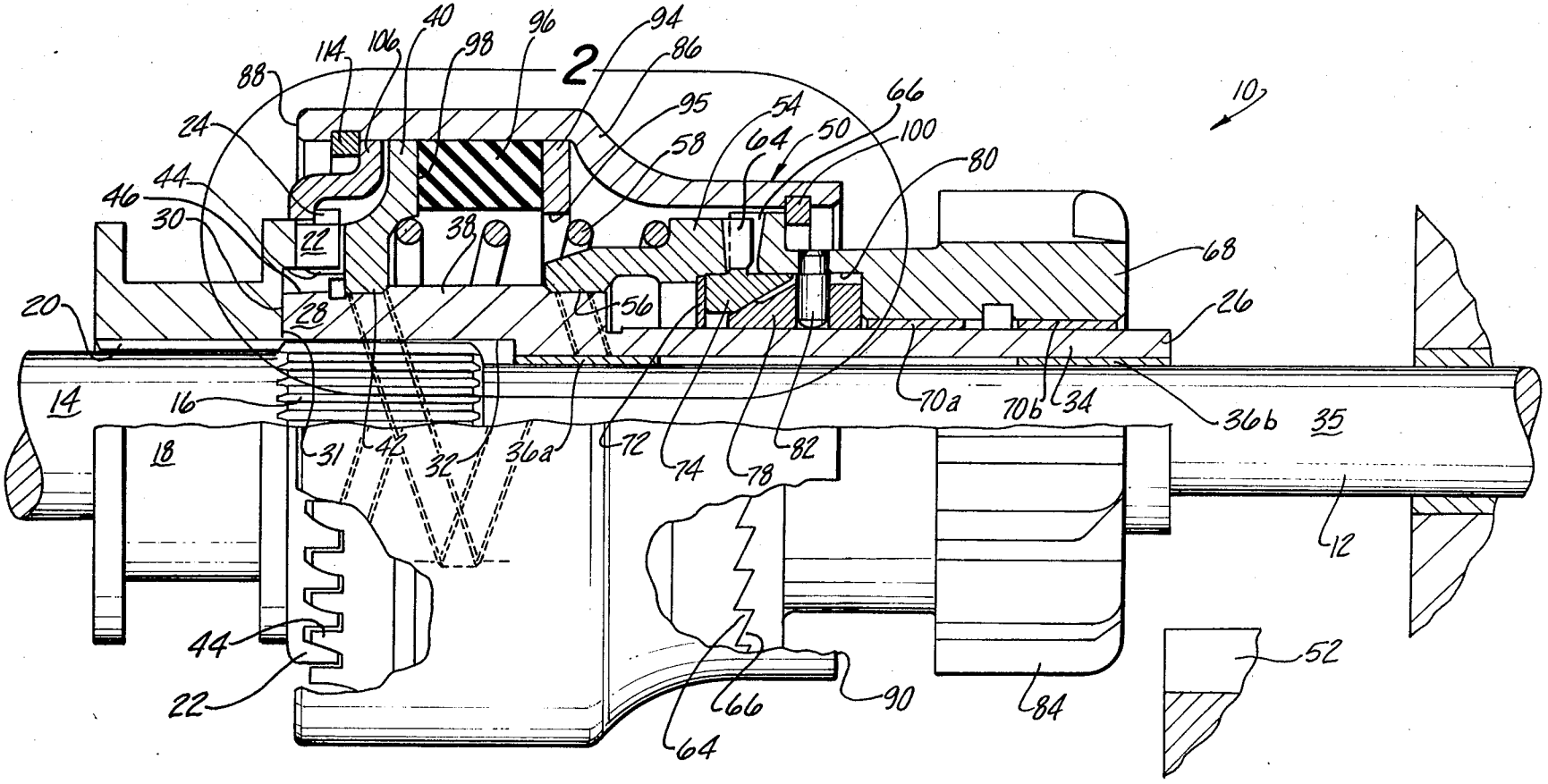
FIG. 1 is a partially cutaway side view of a starter drive according to the present invention.

Referring now to the drawing and more particularly to FIG. 1 thereof, an example of an engine starter drive 10 incorporating the engine starter gearing of the present invention is shown. The engine starter drive 10 is mounted to a power shaft 12 of a starting motor (not illustrated). The power shaft 12 has an large diameter portion 14 having straight external splines 16 thereon. A shift collar 18 is mounted to the power shaft 12 and is provided with straight internal splines 20 engageable with the straight external splines 16 of the power shaft 12.

Figure 2:
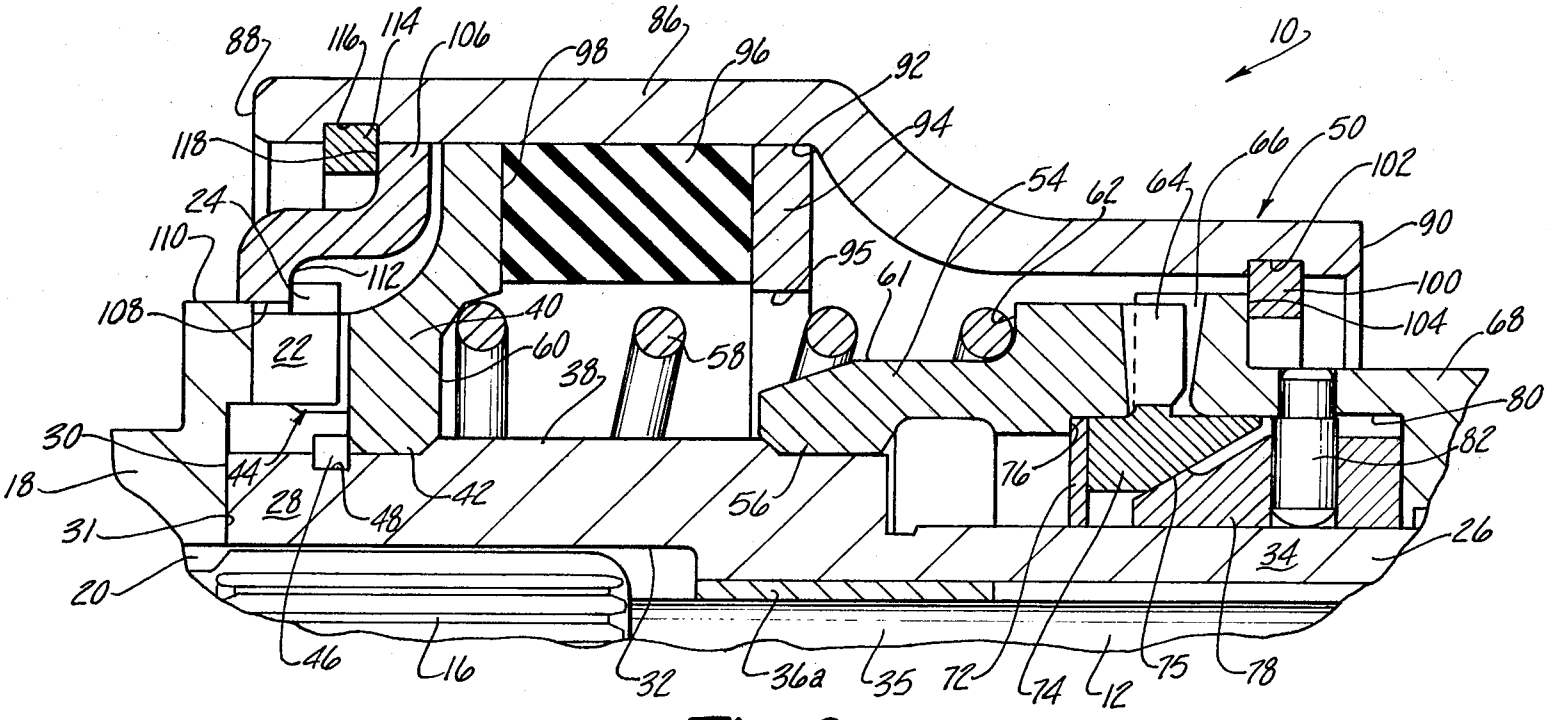
FIG. 2 is an enlarged view of the portion of FIG. 1 indicated by the circle 2.

As shown in FIGS. 1 and 2, the shift collar 18 functions as a secondary driving clutch member and is provided with a first set of overload dentil teeth 22 forming a ring extending longitudinally thereof. The shift collar 18 is further provided with a radially extending flange 24 adjacent the first set of overload dentil teeth 22. The purpose of the radially extending flange 24 will be described later herein.

A sleeve 26 is slidably mounted to the power shaft 12 adjacent the shift collar 18. The sleeve 26 has a first end portion 28 with an end surface 30 abutting an annular surface 31 of the shift collar 18, the annular surface 31 being interior of the ring formed by the first set of overload dentil teeth 22. The first end portion 28 of the sleeve 26 has a clearance bore 32 providing clearance between the first end portion 28 and the straight external splines 16 of the power shaft 12.

A second end portion 34 of the sleeve 26 extends coaxially from the first end portion 28 thereof, the second end portion having a reduced inner diameter and outer diameter as compared with the first end portion of the sleeve. The second end portion 34 is rotatably mounted on a reduced diameter portion 35 of the power shaft 12 by means of suitable bearings, such as the bearings 36*a* and 36*b*.

As best shown in FIG. 2, a set of external helical splines 38 are provided on the outer surface of the first end portion 28 of the sleeve 26. An overload clutch member or secondary driven clutch member 40 is mounted to the sleeve 26 and is provided with a first set of internal helical splines 42 engageable with the set of external splines 38 of the sleeve 26. The secondary driven clutch member 40 is provided with a second set of overload dentil teeth 44 engageable with the first set of overload dentil teeth 22 of the shift collar 18 such as to permit the shift collar 18 to rotatably drive the secondary driven clutch member 40 in one direction of angular rotation. A first lock ring 46 is fitted in a groove 48 in the outer surface of the first end portion 28 of the sleeve 26 in a location adjacent the shift collar 18. The first lock ring 46 acts as an abutment means limiting the displacement of the secondary driven clutch member 40 relative to the sleeve 26 in the direction towards the shift collar 18.

A primary driving clutch member 54 is provided with a second set of internal helical splines 56. The primary driving clutch member 54 is mounted to the first end portion 28 of the sleeve 26 by means of the external helical splines 38 and the second set of internal helical splines 56 at a location remote from the secondary driven clutch member 40. A biasing means, such as a spring 58, is mechanically interposed between the primary driving clutch member 54 and the secondary driven clutch member 40 such as to bias the primary driving clutch member 54 and the secondary driven clutch member 40 away from each other. As best shown in FIG. 2, one end of the spring 58 is disposed in a concave spring engaging portion 60 of the secondary driven clutch member 40 while the other end of the spring 58 is disposed about a cylindrical surface 61 of the primary driving clutch member 54 and abuts an annular spring engaging surface 62 of the primary driving clutch member 54 adjacent thereto. The primary driving clutch member 54 engages a driving subassembly 50 which is selectively engageable with a starting gear 52, shown only in FIG. 1 in the drawing, of an engine, not shown. The driving subassembly 50 may be one of several driving subassemblies, well known in the art, of the overrunning type. However, the preferred driving subassembly 50, as shown in the drawing, is similar to the driving subassembly disclosed in U.S. Pat. No. 3,263,509, issued Dec. 16, 1964 to J. Digby, the disclosure of which is hereby incorporated by reference. Since the driving subassembly 50 is well known in the art, it will not be described in detail.

The driving subassembly 50 includes a first set of primary dentil teeth 64, shown only in FIG. 2, extending from the primary driving clutch member 54, as well as a second set of primary dentil teeth 66 engaged therewith, the second set of primary dentil teeth 66 extending from a primary driven clutch member 68. The primary driven clutch member 68 is rotatably mounted, for example by means of bearings 70*a* and 70*b*, shown only in FIG. 1 of the drawing, to the second end portion 34 of the sleeve 26. Means for accomplishing the automatic separation of the first and second sets of primary dentil teeth 64 and 66 are interposed the primary driving clutch member 54 and the primary driven clutch member 68. An annular thrust member 74 backed by a loose thrust washer 72 abuts a shoulder 76, shown only in FIG. 2 in the drawing, of the primary driving clutch member 54. A plurality of centrifugal flyweight members 78 are disposed in annular cavities 80, as best shown in FIG. 2, and are each reciprocally interconnected with the primary driven clutch member 68 by means of a pin 82. The thrust member 74 and the centrifugal flyweight members 78 are provided with mutually engageable surfaces 75 which cooperate, as taught by Digby, supra, to separate the first and second sets of primary dentil teeth 64 and 66 after the engine becomes self-running.

A pinion gear 84, shown only in FIG. 1, is formed integrally with or, alternatively, is interconnected with the primary driven clutch member 68. The pinion gear 84 is selectively engageable with the starting gear 52 of the engine to be started.

A housing 86 is fitted over the secondary driven clutch member 40, the primary driving clutch member 54, and portions of the shift collar 18 and the primary driven clutch member 68. The housing has an enlarged open end 88 disposed adjacent the shift collar 18 and a small open end 90 disposed adjacent the primary driven clutch member 68. The housing 86 further is provided with an internal shoulder 92, best shown in FIG. 2, formed between the enlarged open end 88 and the small open end 90 thereof. A washer disc 94 is provided adjacent the internal shoulder 92. The washer disc 94 has a clearance aperture 95 therethrough for passage of the spring 58. A resiliently yieldable annulus 96 is interposed a surface 98 of the secondary driven clutch member 40 and the washer disc 94 such as to provide a biasing force therebetween biasing the secondary driven clutch member 40 towards the enlarged open end 88 of the housing 86.

A second lock ring 100 is partially disposed in a suitable groove 102, as shown in FIG. 2, adjacent the small open end 90 of the housing 86. The second lock ring 100 cooperates with an abutment surface 104 of the primary driven clutch member 68. A cap 106 having a central aperture 108 is fitted into the enlarged open end 88 of the housing 86. The cap 106 is further fitted over a cylindrical surface 110 of the shift collar 18 disposed adjacent the radially extending flange 24 such that an inner surface 112 of the cap 106 abuts the radially extending flange 24. A third lock ring 114 is fitted in an annular groove 116 in the inner surface of the enlarged open end 88 of the housing 86. The third lock ring 114 cooperates with an outer surface 118 of the cap 106. Thus, the second and third lock rings 100 and 114 confine the several clutch elements within the cavity of the housing 86.

In operation, when it is desired to crank the engine, the starter drive 10 is shifted to the right, as viewed in the drawing, by way of a positioning mechanism, not shown but well known in the art. The positioning mechanism is connected to the shift collar 18 and shifts the starter drive 10 along the power shaft 12 until the pinion gear 84 engages the starting gear 52. The set of external helical splines 38 of the sleeve 26 cooperates with the second set of internal helical splines 56 of the primary driving clutch member 54 to facilitate alignment of the pinion gear 84 with the starting gear 52 in a known manner. The power shaft 12 is subsequently rotated by a starting motor, not shown, and transmits torque through the straight internal and external splines 20 and 16 to the shift collar 18. The shift collar 18 rotatably drives the secondary driven clutch member 40 through the first and second sets of overload dentil teeth 22 and 44. The secondary driven clutch member 40 rotatably drives the sleeve 26 through the set of external helical splines 38 and the first set of internal helical splines 42 which, in turn, rotatably drives the primary driving clutch member 54 through the second set of internal helical splines 56 and the set of external helical splines 38. The primary driving clutch member 54 drives the primary driven clutch member 68 through the first and second sets of primary dentil teeth 64 and 66, thereby rotatably driving the pinion gear 84 and the starting gear 52 of the engine to be started.

As the engine fires and becomes self-operating, the centrifugal flyweight members 78 of the driving subassembly 50 move radially outwardly to disengage the first and second sets of primary dentil teeth 64 and 66 in a known manner, such as to reduce wear on the first and second sets of primary dentil teeth 64 and 66.

In the event of a backfire or preignition condition, however, the first and second sets of primary dentil teeth 64 and 66 remain engaged. A sudden severe torsional load is experienced by the starter drive 10 which, in the absence of a provision for absorption of the load, could result in damage to the various structural elements used in the starter drive. However, in the starter drive 10 of the present invention, this sudden load is absorbed by a relative rotation between the secondary driven clutch member 40 and the shift collar 18, this relative rotation being resisted by the spring 58 and the resiliently yieldable annulus 96. Under the most extreme sudden torsional loads experienced by the starter drive 10, the first and second sets of overload dentil teeth 22 and 44 may slip one or more teeth relative to each other, thus avoiding damage to the various elements of the starter drive 10.

The present invention, therefore provides a compact, lightweight and easy to assemble starter drive 10 having a provision for absorbing sudden shock torsional loads without damage to its components.

It will be appreciated by those skilled in the art that many variations and modifications may be made from the above described example of the starter drive 10 without departing from the spirit of the present invention and the scope of the claims appended hereto.

What is claimed as novel is as follows:

1. An engine starter for engagement with a starting gear of an engine to be started, said engine starter comprising:

a power shaft;

a pinion gear mounted to said power shaft for axial and rotatable movement relative thereto, said pinion gear further being engageable with said starting gear;

clutch means slidably mounted to said power shaft, said clutch means further comprising:

a primary clutch;

a secondary clutch mounted adjacent said primary clutch to communicate therewith;

said secondary clutch comprising a secondary driving member mounted to said shaft and a secondary driven member mounted concentric to said secondary driving member and communicating with said primary clutch;

said primary clutch comprising a primary driving member and a primary driven member mounted adjacent said primary driving member for communication therewith, said primary driven member further being connected with said pinion gear such that rotational force from said power shaft is translated to said pinion gear by said primary and secondary clutch;

means for resiliently biasing said secondary clutch closed to translate rotational force from said power shaft to said primary clutch for rotating said starting gear of the engine to be started, said resilient biasing means adapted to permit said secondary clutch to slip when torsional force is imposed by said engine to said power shaft; and means for separating said primary clutch when said pinion gear is driven by said starting gear of the engine to be started at a predetermined speed of rotation faster than the speed of said power shaft.

2. An engine starter for engagement with a starting gear of an engine to be started, said engine starter comprising:

a power shaft having a portion disposed adjacent said starting gear;

a sleeve slidably and rotatably disposed on said power shaft;

an external helical spline formed on a first portion of said sleeve;

a primary driving clutch member disposed adjacent said first portion of said sleeve;

a first internal helical spline formed on said primary driving clutch member, said first internal helical spline being engaged with said first external helical spline of said sleeve;

a first ring of primary dentil teeth extending from said primary driving clutch member in a first predetermined direction, said first predetermined direction being towards said starting gear;

a pinion gear slidably and rotatably journalled relative to said power shaft, said pinion gear being selectively engageable with said starting gear by displacement of said pinion gear along said power shaft, said pinion gear further being interposed said primary driving clutch member and said starting gear, said pinion gear further being selectively engageable with said starting gear;

a primary driven clutch member secured to said pinion gear for movement therewith, said primary driven clutch member extending from said pinion gear in a second predetermined direction, said second predetermined direction being a direction opposite said first predetermined direction;

a second ring of primary dentil teeth extending from said primary driven clutch member in said second predetermined direction, said first and second rings of primary dentil teeth being mutually engageable for transmitting torque therebetween in one direction of relative rotation;

a secondary driving clutch member slidably and non-rotatably mounted to said power shaft at a location remote from said starting gear, said secondary driving clutch member being disposed from said sleeve and in abutment therewith;

a first ring of secondary dentil teeth extending in said first predetermined direction from said secondary driving clutch member;

a secondary driven clutch member disposed about said first portion of said sleeve and adjacent said first ring of secondary dentil teeth;

a second internal helical spline formed in said secondary driven clutch member, said second internal helical spline being engaged with said external helical spline of said sleeve such as to movably interconnect said secondary driven clutch member with said sleeve;

a second ring of secondary dentil teeth extending from said secondary driven clutch member in said second predetermined direction, said first and second rings of secondary dentil teeth being mutually engageable for transmitting torque therebetween;

first biasing means mechanically interposed said secondary driven clutch member and said primary driving clutch member such as to bias said secondary driving clutch member and said primary driven clutch member away from each other;

housing means having two open ends, said housing means being slidably supported on said sleeve and spatially encompassing at least a portion of each of said primary and secondary driving and driven clutch members;

first abutment means disposed within said housing means adjacent a first open end thereof of said two open ends, said first abutment means being adapted for engagement with said primary driven clutch member; and second abutment means disposed within said housing means adjacent a second end thereof of said two open ends, said second abutment means being adapted for engagement with said secondary driving clutch member, said first and second abutment means cooperating to rotatably confine at least portions of each of said primary and secondary driving and driven clutch members within said housing means.

3. The engine starter of claim 2 wherein said first biasing means comprises a coil spring.

4. The engine starter of claim 2 further comprising second biasing means interposed said housing means and said secondary driven clutch member, said second biasing means biasing said second ring of secondary dentil teeth into engagement with said first ring of secondary dentil teeth.

5. The engine starter of claim 4 wherein said second biasing means comprises an annular resilient member disposed generally about said first biasing means.

6. The engine starter of claim 5 wherein said housing means comprises an enlarged housing portion adjacent said second end thereof, a reduced diameter portion adjacent said first open end thereof, and an abutment shoulder formed between said enlarged housing portion and said reduced diameter portion; said engine starter further comprising an annular washer disposed within said housing means adjacent said abutment shoulder, said annular resilient member being disposed between said annular washer and said secondary driven clutch member.

7. The engine starter of claim 6 wherein said first biasing means comprises a coil spring.

8. The engine starter of claim 2 wherein said first abutment means comprises a lock ring partially removably inserted in an annular recess formed in said housing means.

9. The engine starter of claim 2 wherein said second abutment means comprises:

an abutment ring partially removably fitted in an annular recess in said housing means; and an annular cap interposed said abutment ring and said secondary driving clutch member.

10. The engine starter of claim 2 further comprising a third abutment means interposed said sleeve and said secondary driven clutch member such as to limit the movement of said secondary driven clutch member in said second predetermined direction relative to said sleeve.

11. The engine starter of claim 10 wherein said third abutment means comprises a ring partially removably inserted in an annular recess in said sleeve.

12. The engine starter of claim 2 further comprising a shift collar secured to said secondary driving clutch member for movement therewith.

13. The engine starter of claim 2 further comprising overrunning means for selectively disengaging said first set and second set of rings of primary teeth when said pinion gear is rotating more rapidly than said power shaft.

14. The engine starter of claim 13 wherein said overrunning means comprises:

an annular cavity formed in said primary driven clutch member;

an annular thrust ring, loosely disposed in said annular cavity and further being adapted to abut said primary driving clutch member when displaced in said second predetermined direction;

an inner conical surface formed on said annular thrust ring;

a plurality of centrifugal flyweight members circumferentially arranged within said annular cavity, said plurality of centrifugal flyweight members each having an inclined surface abutting said inner conical surface of said annular thrust ring, said plurality of centrifugal flyweight members being operative to displace said annular thrust ring in a first axial direction in response to centrifugal force; and guide means corresponding to each of said plurality of centrifugal flyweight members for guiding reciprocating movement for each of said plurality of centrifugal flyweight members radially inwardly and outwardly relative to said power shaft.

15. The engine starter of claim 2 further comprising a plurality of straight splines formed between said power shaft and said secondary driving clutch member, said plurality of straight splines permitting axial movement therebetween while preventing relative rotatable motion therebetween.

* * * * *